United States Patent [19]

Bussey, Jr.

[11] Patent Number: 4,514,453

[45] Date of Patent: Apr. 30, 1985

[54] LOOSE FILL PACKING ELEMENT OF HOOKED CONFIGURATION

[76] Inventor: Harry Bussey, Jr., P.O. Box 115, Serpentine Rd., Navesink, N.J. 07752

[21] Appl. No.: 490,663

[22] Filed: May 2, 1983

[51] Int. Cl.[3] ..... B32B 3/00; B65D 81/02

[52] U.S. Cl. ..... 428/159; 428/156; 428/179; 428/402; 428/542.8; 206/523; 206/584; 206/814

[58] Field of Search ..... 428/33, 159, 179, 402, 428/167, 542.8; 206/523, 584

[56] References Cited

U.S. PATENT DOCUMENTS

| | | | |
|---|---|---|---|
| 3,188,264 | 6/1965 | Holden | 428/33 |
| 3,334,798 | 8/1967 | Pezely, Jr. et al. | 229/14 |
| 3,679,531 | 7/1972 | Wienand et al. | 428/33 |
| 4,166,875 | 9/1979 | Bussey, Jr. | 428/402 X |

*Primary Examiner*—Patricia C. Ives

*Attorney, Agent, or Firm*—Kenyon & Kenyon

[57] ABSTRACT

The packing elements are each formed with a hooked configuration so as to abut each other without interlocking with each other. The free ends of the two legs of each element project beyond the main body portions so as to impart a hooked effect to the elements. The elements can be poured from a hopper into a container.

9 Claims, 7 Drawing Figures

LOOSE FILL PACKING ELEMENT OF HOOKED CONFIGURATION

This invention relates to a loose fill packing element and to a packing material comprised of packing elements of hooked configuration.

As is known, various types of packing materials have been used to insulate articles being transported in shipping containers against the danger of damage from vibration and impact forces. Further, in order to avoid the disadvantages of packing materials such as excelsior, pop-corn, and the like, it has also been known to use resilient thermoplastic elements for the packing materials. In many cases, these elements have been produced in shapes to provide not only a cushioning effect for the article being shipped but also a nesting relation or interlocking arrangement with each other to prevent migration of the packaged article during the course of shipment. Generally, when an article is to be packaged, an empty shipping carton is first opened and a mass of elements are poured from a supply hopper into the shipping carton to fill the carton part way. Thereafter, the article is placed in the carton and a further mass of elements are poured from the supply hopper into the carton to a point of overfill. Next, the carton is closed in a manner such that the overfilled elements are pressed down into the carton. This causes the various elements to press together in an interlocking manner or a nesting manner depending on the shapes of the elements.

However, because of the interlocking or nesting characteristics, the packing material elements may interlock or nest while in the hopper so that a jamming of the hopper occurs which prevents free flow of the elements out of the hopper. It has also been found that vibration of a packed shipping carton during shipping may cause the packing elements to settle to such an extent that the packaged item may migrate within the carton. This may lead to damage of the article should the carton be dropped. Further, it has been found that when the packaging material is packaged for resale in containers such as bags or boxes, for example by a manufacturer, the material may occupy less volume in the container when purchased by a user due to settling. This, in turn, may give the user a false impression that there is a short-weight condition.

Accordingly, it is an object of the invention to provide a packaging material made up of packing elements which will not settle to any appreciable extent during shipment in containers.

It is another object of the invention to provide a packaging material of packing elements which do not interlock and do not nest with each other.

It is another object of the invention to provide a loose fill packing element which occupies a maximum space with a minimum of weight.

It is another object of the invention to provide a packing material of relatively low bulk weight.

Briefly, the invention provides a loose fill free flowing packing material comprised of a plurality of resilient thermoplastic elements wherein each element has a substantially uniform thickness and provides a relative minimum of bulk weight per occupied volume. In particular, each element has a body portion having flat surfaces on opposite sides and a pair of integral legs, one of which extends from one end of the body portion to pass through a plane of one flat surface while the other leg extends from an opposite end of the body portion to pass through a plane of the other flat surface. In addition, the body portion has a recess in each flat surface adjacent to a respective leg.

Each recess of the packing element is shaped with an increasing width inwardly from the mouth to reduce the amount of material used in the element. Likewise, each leg is of a decreasing width inwardly of the end to reduce the amount of material used in the element. The end of each leg is also of a width greater than the width of the mouth of a recess so that the legs of one element cannot fit into the recesses of another element.

By having the legs project through the planes of the opposite surfaces of the body portion, a hooked configuration is provided. This hooked configuration allows the elements to hook into each other a slight amount should two elements be aligned one over the other. However, significant hooking of the elements into each other does not occur unless a large number of elements, e.g. ten or more are brought together. The projecting legs also provide for spaces between the individual elements of a packing mass so as to reduce the bulk weight of a given volume of the packing material.

The legs of the packing elements are positioned so that the exterior surfaces of each is co-planar with an exterior surface of the body portion at the respective ends of the body portion. In this regard, the exterior surfaces may be disposed at an angle to the flat surfaces of the body portion.

Since the elements of the packing material do not interlock, the elements may flow more freely, for example from a hopper into a shipping carton. Further, the hooked configuration of the elements provides a stable shape which does not interlock or nest so that shifting or settling of the elements does not occur in a shipping carton or when shipped in a container for resale.

The packing material also provides a minimum weight per unit of volume due to the spaces provided by the recesses in the elements and the outwardly extending legs which space the elements apart from each other.

It is to be noted that the packing material is able to flow freely from a hopper into a shipping carton, since the legs of the individual packing elements do not hook into each other to cause jamming of the hopper. However, once placed in a shipping carton which has been filled to an overfilled condition and then closed, the elements are compressed against each other such that the hooked configuration of the elements preclude migration of the elements under a vibratory force or an impact force.

It is to be noted that the shape of the legs of each packing element also provide an inherent resiliency. That is, each leg may flex resiliently about the narrowed end, for example, to absorb an initial shock if a shipping carton is dropped. Further, the legs are of a sufficient strength not to break if flexed about the narrowed ends under the usual loads imposed upon a shipping carton. In this regard, there is a relationship between the gap provided by the recesses and the narrowness of the leg. This relationship depends in part on the material which is used for the packing elements, for example a resilient foam thermoplastic material such as polystyrene or polyethylene.

These and other objects and advantages of the invention will become more apparent from the following detailed description and appended claims taken in conjunction with the accompanying drawings in which:

Figure 1:
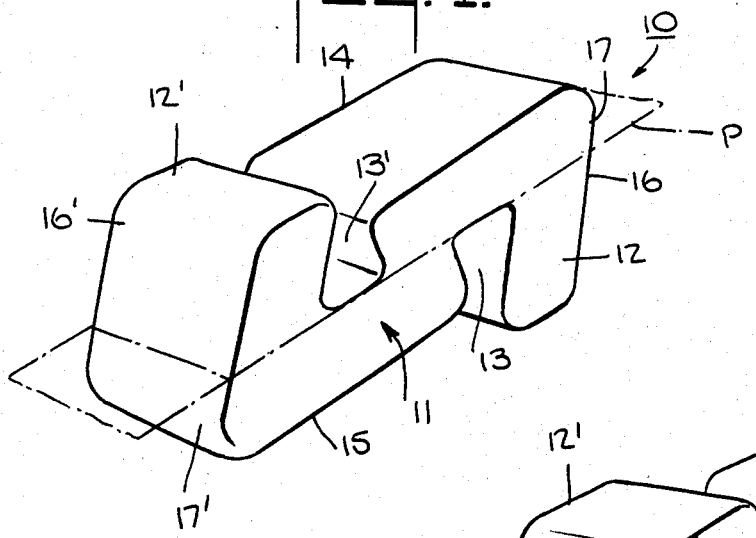
FIG. 1 illustrates a perspective view of a packing element according to the invention.

Referring to FIG. 1, the packing element 10 is of a block-like S-shape of substantially uniform thickness and includes a main body portion 11, a pair of integral legs 12, 12′ and a pair of recesses 13, 13′.

As shown, the body portion 11 has a flat top surface 14 and a flat bottom surface 15 which are disposed in parallel relation. In addition each leg 12, 12′ extends from an end of the body portion 11 such that the exterior surface 16, 16′ of each leg 12, 12′ is co-planar with the exterior end surface 17, 17′ of the body portion 11. The legs 12, 12′ also extend from a common plane P through the body portion 11 to reduce overall bulk. Each recess 13, 13′ is located in a respective surface 14, 15 of the body portion 11 adjacent a respective leg 12, 12′ such that a wall of the leg is common to the recess. As illustrated, each leg 12, 12′ is of decreasing width inwardly of the terminal end. Likewise, each recess 13, 13′ is of increasing width inwardly of the mouth thereof. In addition, each leg 12, 12′ is of a width at the end which is greater than the width of a recess 13, 13′ at the mouth thereof.

The legs 12, 12′ extend from a common plane P passing through the body portion 11 and project past the plane of the top or bottom surfaces 14, 15, respectively of the body portion 11, for example a distance of one millimeter.

The packing element 10 is made of any suitable material, for example of an extruded foamed thermoplastic material such as polystyrene, polyethylene, polypropylene or polyurethane. Further, the packing element 10 may be provided in an expandable state or an expanded state, as is known.

Figure 2:
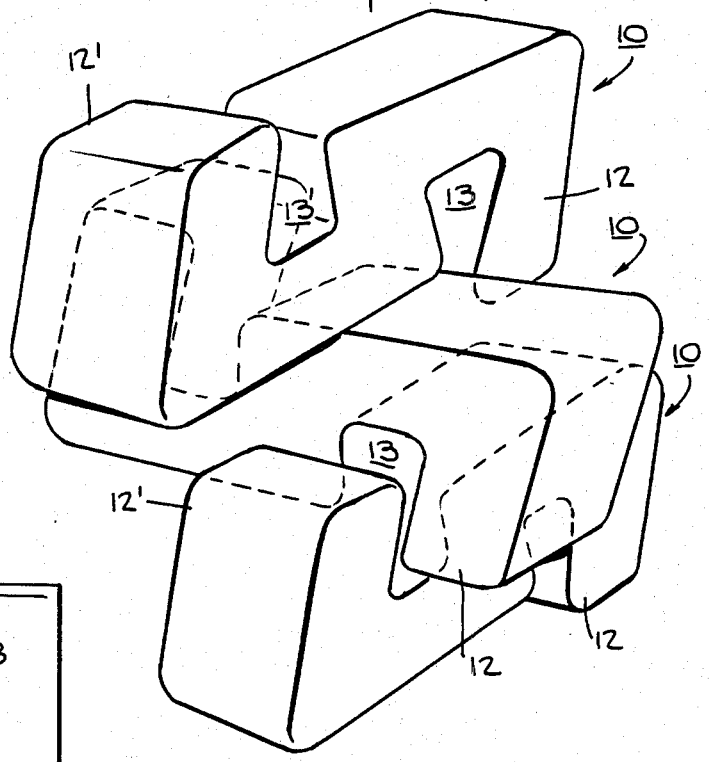
FIG. 2 illustrates one spatial relationship of a plurality of packing elements in accordance with the invention.

A packing material 18 which is made up of a plurality of the elements 10 is characterized in that the elements 10 do not interlock with each other. In this respect, the ends of the legs 12, 12′ do not fit into the recesses 13, 13′. When the elements 10 are in contact with each other (see FIG. 2) the projecting legs 12, 12′ provide a slight hooking effect. This hooking effect allows the elements 10 to flow relatively easily when flowing from a hopper 19 (see FIG. 5) into a container 20.

Figure 3:
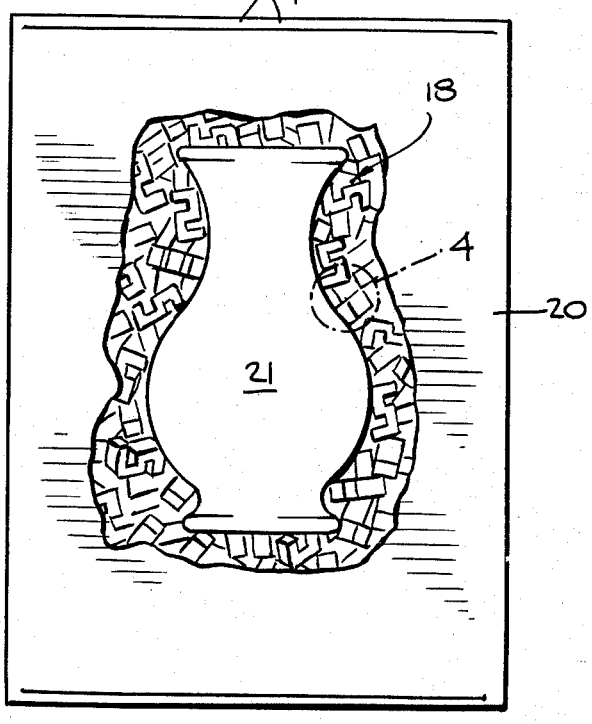
FIG. 3 illustrates a partial sectional view of a shipping carton containing an item packed with the packing material according to the invention.
Figure 4:
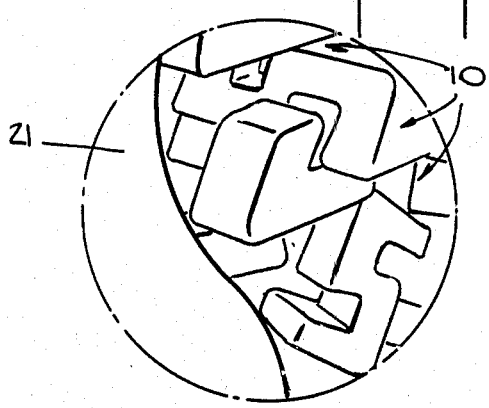
FIG. 4 illustrates an exploded detail view taken within the encircled portion of FIG. 3.

Referring to FIG. 3, when in use, the packing material 18 is poured into the container 20 about the item 21 to be packaged in an amount to slightly overfill the container 20. The flaps 22 of the container 20 are then closed and pressed down so that the elements 10 become tightly packed and slightly compressed. In this state, the elements 10 tend to form a cocoon about the item 21 and are compressed against each other in a manner such that settling or migration of the elements 10 or item 21 is prevented. Further, as one part of an element 10 does not fill the reverse part of the adjacent element 10, the elements 10 provide relatively large voids or air spaces not only within the recesses 13, 13′ but also between the respective elements 10. This reduces the number of elements required to package an item and, in turn, reduces the overall weight of the packing material required and the weight of the shipping carton 20. Further, the slight hooking effect of the individual elements 10 with respect to an adjacent element 10 allows for tight packing while in the shipping container under pressure and seal. This keeps migration to a minimum.

It is to be noted that when the elements 10 are in the shipping container 20, the legs 12, 12′ may "give" both horizontally and vertically. That is, the legs 12, 12′ may be resiliently compressed and may be flexed to a slight degree towards or away from the adjacent recess 13, 13′. Thus, an extra cushioning effect is provided in addition to the hooking effect.

It is to be noted that when an item is packaged, the packing material remains in place and does not migrate. Thus, should the shipping container be vibrated, for example during transportation, the packaging material will not settle. Further, when the packing material is packaged for resale, for example in bags or boxes, there will be little, if any, settling of the elements because the elements do not nest and interlock with each other.

Figure 5:
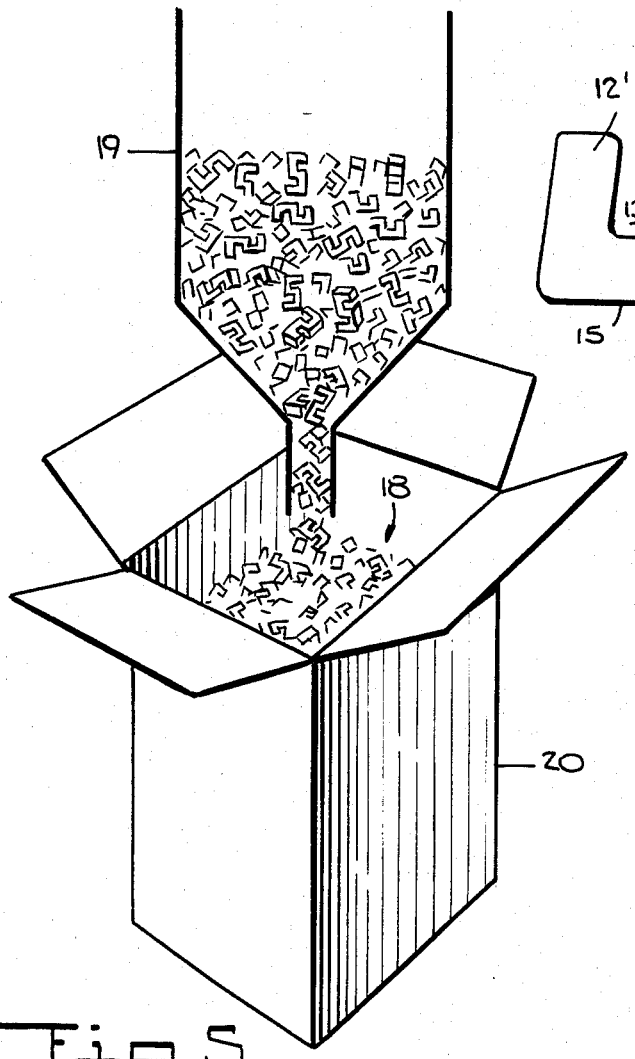
FIG. 5 illustrates a cross-sectional view of a supply hopper discharging packing material of the invention into a shipping carton.
Figure 6:
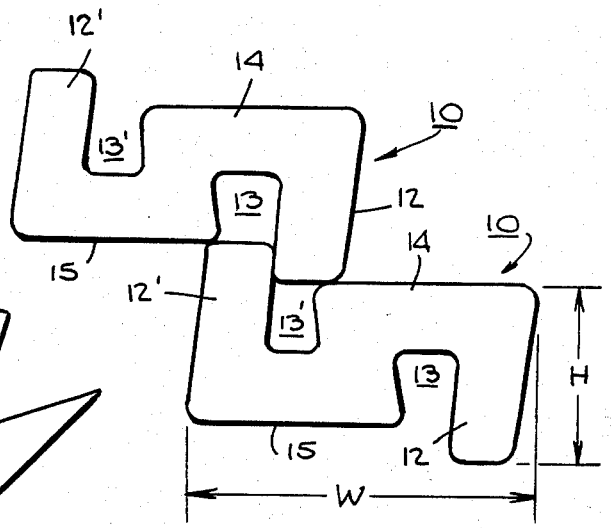
FIG. 6 illustrates a side view of two packing elements disposed in hooking relationship with respect to each other in accordance with the invention.

Referring to FIG. 6, should two elements 10 be disposed in aligned overlying relation to each other, the elements 10 will not fit into each other. Accordingly, when the elements 10 are poured, for example from a hopper 19, as shown in FIG. 5, the elements 10 will be free flowing.

Figure 7:
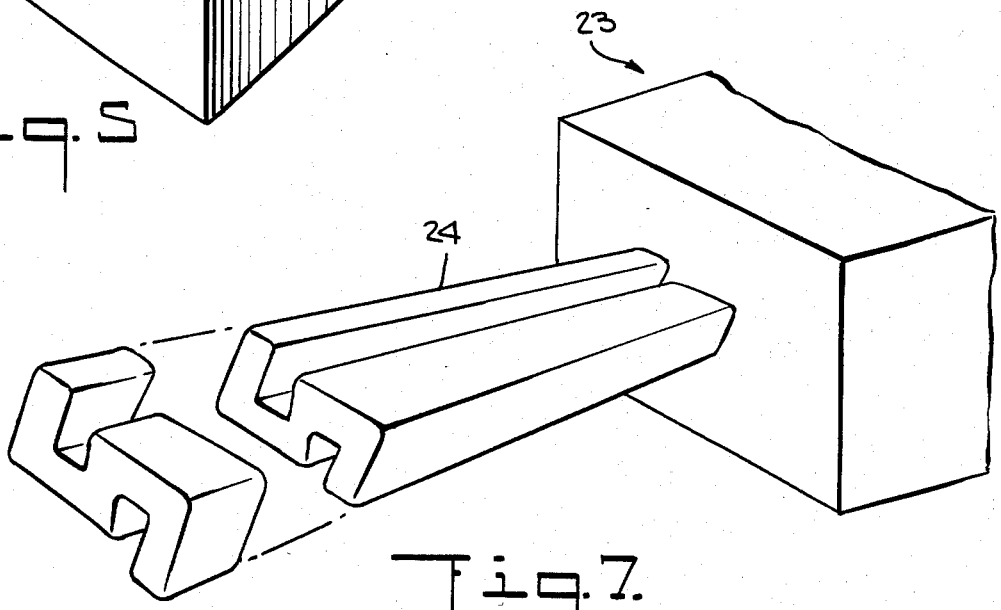
FIG. 7 illustrates a perspective view of an extruder during extrusion of a bar-like form from which the packing elements may be severed.

Referring to FIG. 7, in order to make the packing elements 10, a process such as described in U.S. Pat. Nos. 3,074,543 and 3,188,264 may be used. In this case, a mass of granular particles of a suitable thermoplastic material is placed in an extruder 23 together with a suitable blowing or expanding agent as is known. An extrudate is then formed which is extruded through a die having an outlet of block S-shape in order to produce a bar-like form 24 of block S-shaped cross-section. The bar-like form 24 is then cut transversely of the longitudinal axis of the extrusion at intervals along the extruded length into small pieces by a suitable cutting means (not shown) prior to expansion to form individual discrete foamable elements. Alternatively, by use of heretofore known processes, the elements may be fully expanded at the time of extrusion and cutting or may be provided in a latent-foaming or expandable state following extrusion.

The overall dimensions of the packaging elements 10 are relatively small, for example in an expanded state when used for packing the elements have a thickness (in the extruded direction) of $\frac{1}{4}$ to $\frac{3}{4}$ inches, an overall width W of $\frac{1}{2}$ to $1\frac{1}{2}$ inches and an overall height H of $\frac{3}{8}$ to $1\frac{1}{2}$ inches while the legs 12, 12′ project beyond the flat surfaces 14, 15 of the body portion 11, for example by one millimeter or 1/32 of an inch.

The invention thus provides a packing material which, when placed in a container, forms a substantial mass wherein each packing element is virtually connected to the other due to the hooking effect. In addition, the packing material forms a cocoon about the packaged item in which the item is completely surrounded by the packing elements.

The invention further provides a packing material which is of minimal weight per unit volume, is free-flowing, has minimal-settling characteristics and has a spring effect without interlocking.

Further, the invention provides a packing element which can be easily manufactured. For example, the elements can be extruded without need for special attachments. Also, the extrusion equipment does not require any special downstream components such as complicated flywheel cutters or pressing wheels.

The invention further provides a resilient thermoplastic packing element which can be made of higher density than previously known thermoplastic packing elements so as to achieve a stronger product without increasing the weight of the overall packing material.

What is claimed is:

1. A loose fill free flowing packing material comprising a plurality of resilient thermoplastic elements, each said element having a substantially uniform thickness, a body portion having a first flat surface on one side and a second flat surface on an opposite side, a first leg extending integrally from one end of said body portion and passing through a plane of said first surface, a second leg extending integrally from an opposite end of said body portion and passing through a plane of said second surface, a first recess in said first flat surface adjacent said first leg, and a second recess in said second flat surface adjacent said second leg each leg being of a width at the end thereof greater than the width of a respective recess at the mouth thereof, each said leg being of decreasing width inwardly of said end thereof and each said recess being of increasing width inwardly of said mouth thereof to prevent each leg from fitting into a recess of a like element.

2. A loose fill packing material as set forth in claim 1 wherein each leg is of a width at the end thereof greater than the width of a respective adjacent recess at the mouth thereof.

3. A loose fill packing material as set forth in claim 2 wherein each said recess is of increasing width inwardly of said mouth thereof.

4. A loose fill packing material as set forth in claim 2 wherein each leg is of decreasing width inwardly of said end thereof.

5. A loose fill packing material as set forth in claim 4 wherein each said recess is of increasing width inwardly of said mouth thereof.

6. A loose fill packing material as set forth in claim 1 wherein each element is made of expandable thermoplastic material.

7. A loose fill packing material as set forth in claim 1 wherein each element is made of expanded thermoplastic material.

8. A loose fill packing material as set forth in claim 1 wherein each leg projects past a respective plane of said body portion a distance of one millimeter.

9. A loose fill packing element of resilient thermoplastic material, said element having a body portion with a first flat surface on one side and a second flat surface on an opposite side, a first leg extending from one end of said body portion through a plane of said first surface, a second leg extending from an opposite end of said body portion through a plane of said second surface, a first recess in said first flat surface adjacent said first leg, and a second recess in said second flat surface adjacent said second leg each leg being of a width at the end thereof greater than the width of a respective recess at the mouth thereof, each said leg being of decreasing width inwardly of said end thereof and each said recess being of increasing width inwardly of said mouth thereof to prevent each leg from fitting into a recess of a like element.

* * * * *